United States Patent [19]

Roepke et al.

[11] 4,025,116

[45] May 24, 1977

[54] METHOD OF OPERATING A CONSTANT DEPTH LINEAR CUTTING HEAD ON A RETROFITTED CONTINUOUS MINING MACHINE

[75] Inventors: Wallace W. Roepke, Excelsior; Kelly C. Strebig, West St. Paul; Bradley V. Johnson, Minneapolis, all of Minn.

[73] Assignee: The United States of America as represented by the Secretary of the Interior, Washington, D.C.

[22] Filed: Aug. 14, 1975

[21] Appl. No.: 604,566

[52] U.S. Cl. ..... 299/17; 299/10; 299/34; 299/76; 299/81

[51] Int. Cl.² ..... E21C 25/00; E21C 25/60; E21C 25/68

[58] Field of Search ..... 299/18, 10, 64, 69, 299/76, 86, 81; 299/32, 34

[56] References Cited

UNITED STATES PATENTS

| | | | |
|---|---|---|---|
| 1,637,783 | 8/1927 | Morgan | 299/32 |
| 1,710,887 | 4/1929 | Morgan | 299/10 |
| 1,851,037 | 3/1932 | Chubbuck | 299/68 X |
| 2,730,343 | 1/1956 | Sloane | 299/94 X |
| 2,750,178 | 6/1956 | McCallum | 299/69 |
| 2,792,205 | 5/1957 | Hagenbook | 299/10 X |
| 3,032,325 | 5/1962 | Peterson | 299/76 X |
| 3,556,599 | 1/1971 | Fiske | 299/18 X |
| 3,813,126 | 5/1974 | Rogne | 299/17 X |
| 3,907,093 | 9/1975 | Skibo | 299/64 |

*Primary Examiner*—Ernest R. Purser
*Assistant Examiner*—William F. Pate, III
*Attorney, Agent, or Firm*—Thomas Zack; Gersten Sadowsky

[57] ABSTRACT

A method of operating a machine having a constant depth linear cutting head which is retrofitted to a continuous mining machine replacing the rotary head. By altering the usual configuration of the cutting head from the high speed rotating type with a large number of bits, as is currently being used, to one employing a non-rotary type head with 10 percent or less of the usual number of bits, and also operating a combined sumping and shearing action without the bits exiting the coal face being cut, less respirable dust is produced at the mine face. In addition to decreasing the dust and amount of menthane gas - when coal is mined - which is liberated, our method also produces more coal on the average for each cut in the mine face by deeper constant depth cuts in the 3- to 6-inch range by first sumping into the mine face and then shearing the face, without withdrawing or rotating the point attack bits. Sumping may begin near the mine face roof or floor and shearing may be in either a vertical or horizontal direction with or without the aid of high pressure water. One modification calls for shearing with two opposite cutting heads moving towards the mine face center.

11 Claims, 5 Drawing Figures

METHOD OF OPERATING A CONSTANT DEPTH LINEAR CUTTING HEAD ON A RETROFITTED CONTINUOUS MINING MACHINE

BACKGROUND OF THE INVENTION:

1. Field of the Invention:

The invention described herein is a method for operating a continuous mining machine with a linear cutting head having a new mechanical configuration.

2. Description of the Prior Art:

Continuous mining machines employing cutting bits on a rotating head have been used for some time. Our invention employs a non-rotating type head with fewer bits modifying the previously used methods by first sumping into the mine face and then shearing the mine face without retracting the cutting bit from the mine face. Of the known prior art U.S. Pat. No. 2,730,343 to W. W. Sloane appears closest to our invention, However, significant differences exist in that Sloan's invention uses a wedging action to impact the bits and insert the cutters into the coal thereby breaking out large pieces and withdrawing the cutting head from the coal face to reinsert it for the next breakage to occur by wedging action. Such a method would not only produce much less mined material per unit time than our invention but would also produce more dust, both of which are contrary to the stated objectives of this invention.

SUMMARY OF THE INVENTION:

The continuous mining machine of this invention is moved to a position adjacent the mine face. Then beginning at the roof or floor of the mine face, the point attack bits are sumped into the face a given distance which is at least 3 inches. Next, without retracting the cutting bits from the face, the face is continuously sheared top to bottom or bottom to top across most of its full width in one pass and the material extracted is conveyed away from the face and mine machine. Normally, the sumping into the mine face is about 6 inches and the shearing substantially the total height and width of the of the mine face. After completing both steps, the machine is moved up to the mine face while the cutting bits are moved to the roof or floor, again sumped into the mine face, and then shearing takes place. During this process the extracted coal is continuously being conveyed away from the mine face. This process continues until the desired amount of material is extracted.

The primary object of this invention is an improved method of extracting material from a mine using a continuous mining machine retrofitted with a constant depth linear cutter head.

Although the invention will be described with respect to coal mining for which it was primarily developed, other types of mining operations faced with the same problems could conceivably benefit. Before elaborating on the details of the invention, the problems it is directed to should be looked into. The major problem sought to be solved by our invention was to reduce respirable dust at the mining face from a continuous mining machine operation without sacrificing operational efficiency. If this could be accomplished, then the next problem would be to increase production without sacrificing safety.

One of the most widely used types of continuous mining machines (CCM) employs a rotary cutting head having 100 to 150 bits and a bit rotational speed of about 60 revolutions per minute. These cutting bits usually penetrate no more than one inch into the coal mine face and thereby produce excessive quantities of respirable dust as they cut in the coal. Generally, they may be thought of as rotating shallow types of cutters. Research conducted by the United States Bureau of Mines has shown that by cutting with this type of rotary head and by imparting a lower number of revolutions per minute (rpms) to the head, less of this unhealthy and dangerous dust is producted. However, to attain the lower number or rpms needed and still achieve the depth of penetration desired presents a problem since not enough torque can be transmitted to the rotating head.

Figure 1:
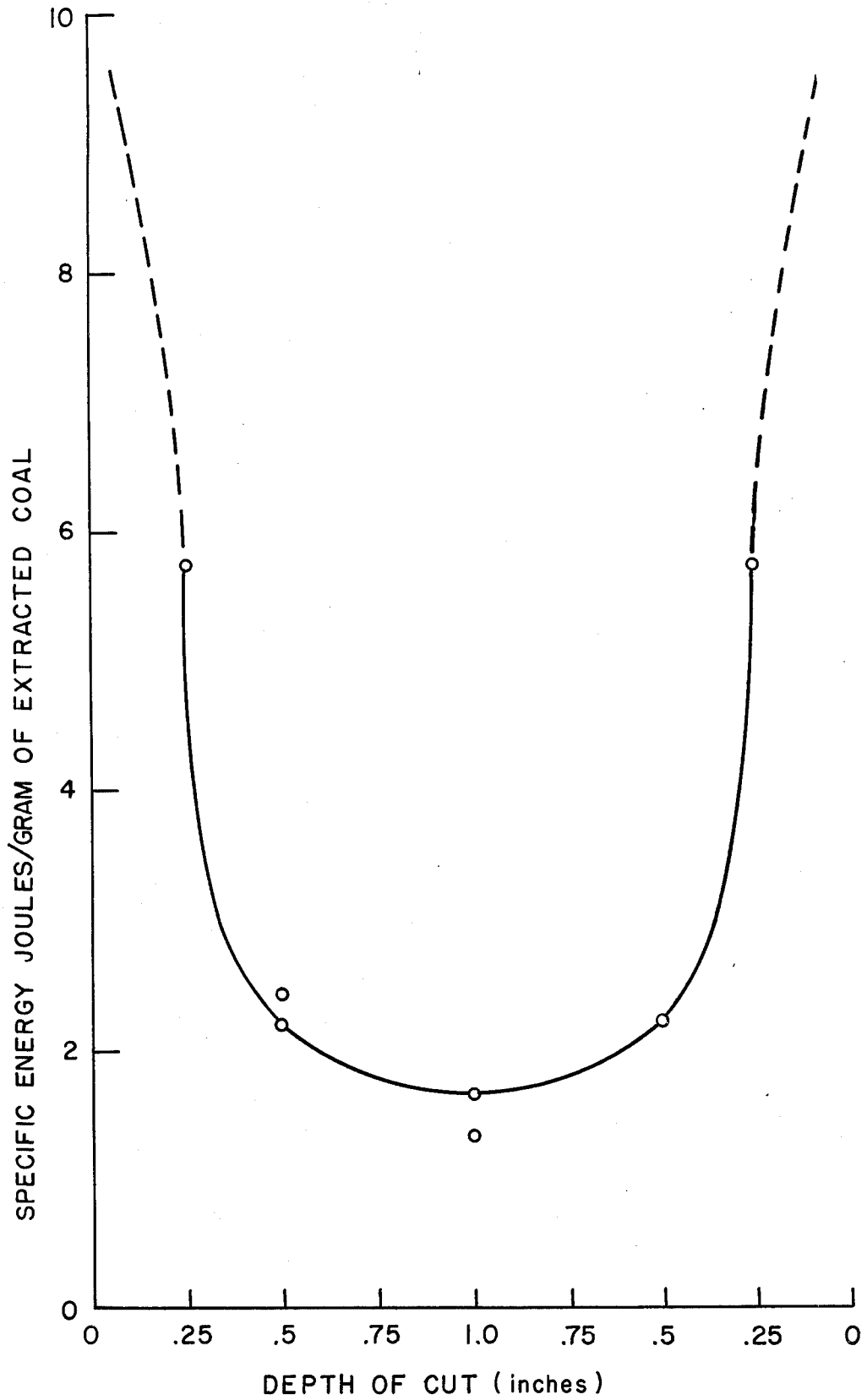
FIG. 1 is an energy profile graph for a rotary head cutter.

The graph of FIG. 1 illustrates typical tests results obtained from a rotating cutter. It is the plot of the energy profile for a single plumb-bob bit with a bit attack angle of forty-five degree where there are two inches between the centers of cuts. The Y-axis shows the specific energy in joules per gram of coal extracted and the X-axis the depth of the cut in inches between 0.25 and 1.0 into the coal mine face. The dashed graph lines represent extrapolated values below 0.25 inches based on analytical results. The basic conclusion to be drawn from this graph is that at a depth of one inch a rotary cutting head has its best or most efficient energy profile. Test data from depths greater than one inch support this conclusion i.e., the amount of energy consumed decreases as the cutting depth increases. If this conclusion is considered in light of a second finding — namely that the amount of airborne respirable dust generated is a cubic function of a cutters energy profile — then it can be stated as a corollary that using a rotary cutter is not the way to reduce dust. Tests have in fact shown that the less the depth of the cut the greater will be the amount of respirable dust and energy per unit volume generated. When the depth of the cuts are less than one inch, the dust generated has been shown to increase exponentially towards a maximum value as the depth of cut approaches zero varying as the cube of the energy curve in FIG. 1.

Our approach to overcome this problem has been to develop a deep cutting non-rotary head design which cuts the mined material at a constant depth. This approach will not only produce less dust per cut but has been shown to be more efficient in terms of reduced power consumption per volume of coal removed. Further, less of the coal surface area will be generated due to the deeper cuts thereby liberating less of the potentially explosive methane gas. To better illustrate the relationship between the cut depth and reduction of dust generated for a single bit on a rotary head making one complete revolution, Table I was developed to show the effect of reducing the area of maximum dust production between zero and one-half inch depth by increasing the depth of cut. For a one inch deep crescent (shaped) cut by a point attack bit making one pass at the face on a continuous mining machine (CMM) greater than 65 percent of the cutting energy will be expended while producing at least 88 percent of the primary dust at the mine face in less than 15 percent of the total area of coal removed. Based on our tests, we have concluded that the dust produced with a CMM can be decreased by increasing the depth of cut until an economic and engineering optimum depth between three and six inches is reached.

TABLE I

| Percentage of Area Between 0 and ½ Inch for Total Cut Area | Maximum Depth of Crescent Shaped Cut (Inches) | Percent Reduction of Dust Producing Area, Between 0 and ½ inch |
|---|---|---|
| 100 | 0.5 | 0 |
| 13.4 | 1.0 | 87 |
| 3.2 | 2 | 97 |
| 1.4 | 3 | 98.5 |
| 0.77 | 4 | 99.3 |
| .50 | 5 | 99.5 |
| .34 | 6 | 99.6 |

In order to achieve our objective of reducing the respirable dust generated at the mine face and at the same time maintain or exceed the four to seven tons per minute of the cut material now expected from a CMM, it is necessary to modify the existing equipment available by eliminating the rotary head. It should be pointed out that an average production rate of 700 tons per shift is being achieved nationally. This means that only 2.1 to 4.6 hours of machine time are used each day. This low level of use is partially due to the fact that any greater use would create excessive dust.

Our invention addresses itself specifically to this problem since the low level of dust generated by our device will allow truly continuous operation without exceeding the standards set out in the regulations implementing the Federal Coal Health and Safety Act of 1969 (Public Law 91–173 ) as to the maximum amounts of respirable dust allowable.

Figure 3:
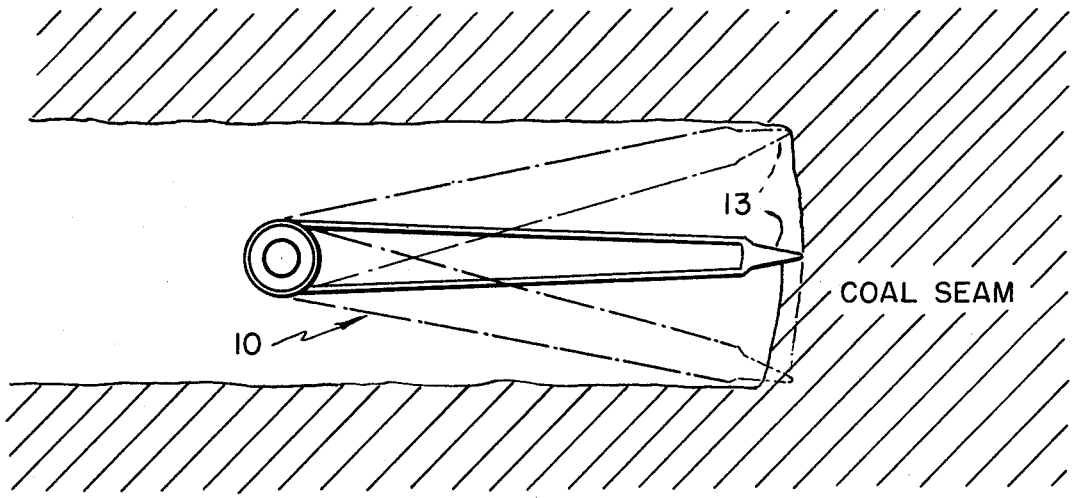
FIG. 3 is a side view of one type of cutting head usable to sump and shear the material from a mine face.
Figure 4:
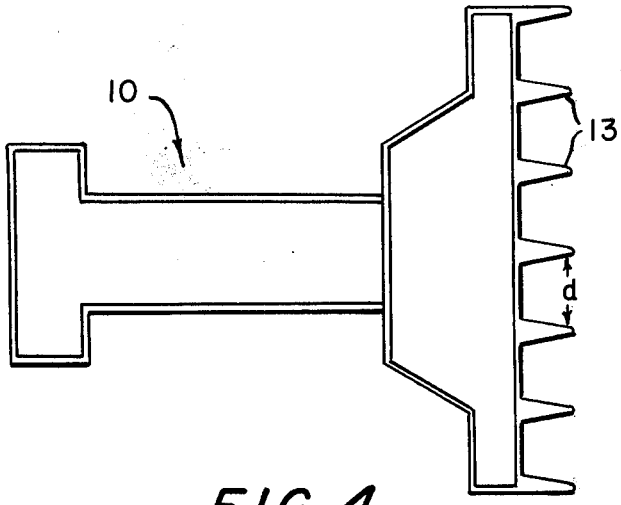
FIG. 4 illustrates a top view of the FIG. 2 cutting head.
Figure 5:
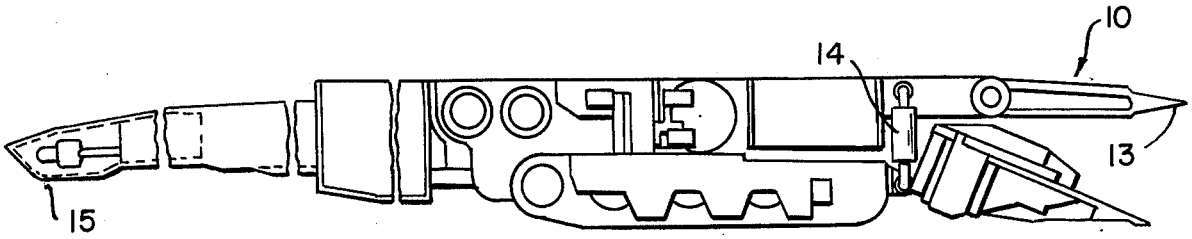
FIG. 5 is the illustrated cutting head retrofitted on an existing continuous mining machine.

FIGS. 3 to 5 illustrate the preferred type of equipment which could be used to practice our method. In FIGS. 3 and 4 a cutting head 10 having seven bits 13 that can sump into the coal seam and then shear it is illustrated. The spacing, *d*, between consecutive bits follows the general practice of 2.5 to three times the depth of penetration. Thus, for a six inch penetration depth the spacing between adjacent bits would be fourteen to fifteen inches. This head 10 can be moved forward into the coal seam face under hydraulic pressure and also up and down (or if desired sideways) under hydraulic pressure. It may also be desirable to augment the cutting action of these bits with high pressure (10,000 psi or more) jets of water. Normally, these jets located at the center line of the bits' point would precut holes or slots into the coal face for the bits to sump into. In this way, the need to generate a high sumping force would be eliminated. These same high pressure water jets may also be used to reduce the amount of shear force needed. Generally, without the use of these supplemental jets, a force of about 12,000 pounds would be required for each bit to sump or shear the six inches needed into the coal seam. This 12,000 pound force, which is well within the present state of the art for continuous mining machines, will be generally the same for both sump and shear operations.

To get an idea of the amount of coal production possible with our invention, assume a six foot high times ten foot wide times six inch deep cut is to be made at a sump rate of an inch per second, a sheer rate of one foot per second, and allow five seconds for the return of the bits to the next cutting position on the coal face. Then the amount of coal with an 80 pound cubic foot density would be 2,400 pounds per cut in 17 seconds per pass. For each minute of continuous operation, this amounts to 4.24 tons per minute of production or 254 tons per hour. During the normal seven hour working shift (eight hour day) this works out to 1,788 tons of coal. Even this figure can be increased if the constant depth linear cutting head were composed of two identical heads mounted in such a manner that one sumped at the roof and cut to the mid-stream height with the other head simultaneously sumping at the floor and cutting up to meet at mid-seam. This type of arrangement would reduce the 17 second cycle per pass by three seconds on the shear and 2.5 seconds on the return. Thus, by using two heads a 48 percent increase over our original estimate could be achieved or a production rate of 2,600 tons per day. This potential rate is much faster than present haulage systems can handle and, therefore, modifications to the haulage systems would be required.

Dust generation during cutting must be reduced to comply with safety regulations of the Mining Enforcement and Safety Administration. At the same time, the President's goal of doubling coal production by 1985 has to be considered. When present high speed rotary cutting heads enter and exit from the coal face at depths of less than one inch, there is an inherent large amount of dust produced due to the shallow cutting action during entry and exit of each bit but this is increased by regrinding and fanning action of the rotary head. This dangerous condition has been eliminated by our invention without sacrificing coal production.

Figure 2:
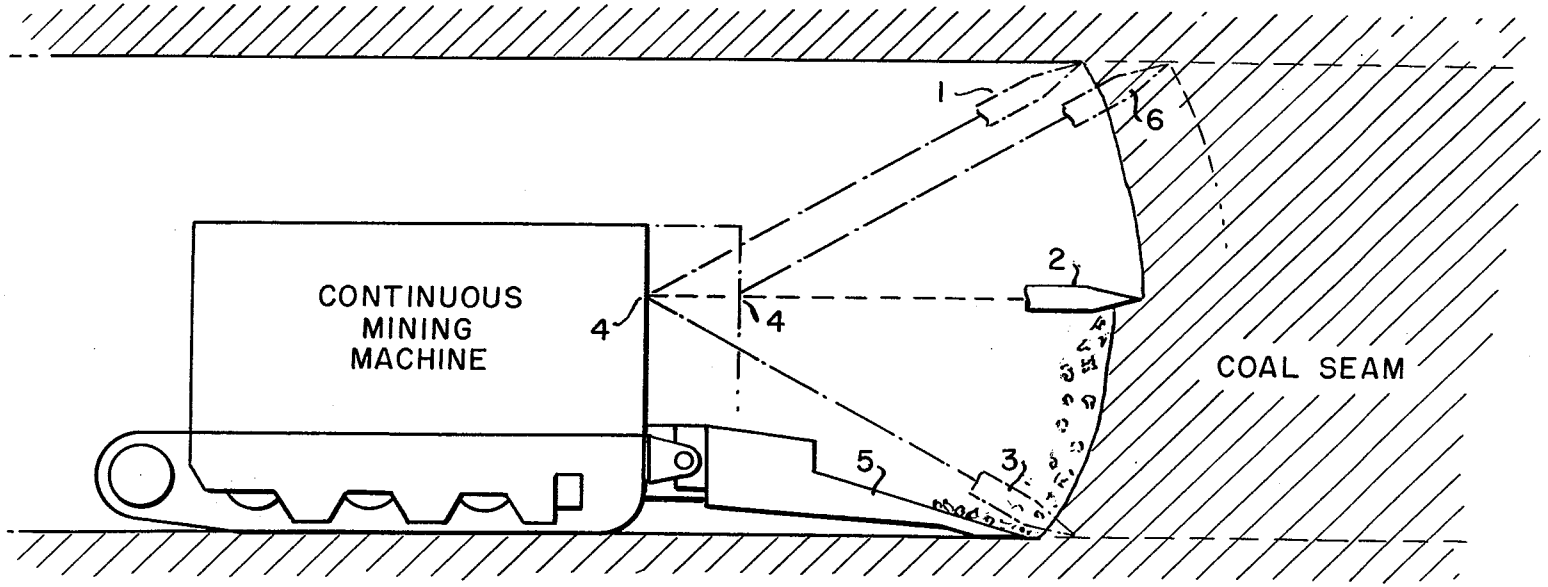
FIG. 2 is a schematic diagram of the steps to be taken to practice our method in a mine.

FIG. 2 schematically illustrates how our invention works. Initially, at the step 1, the cutting head of the continuous mining machine (CMM) is positioned at the mine roof and then sumped into the face as shown by step 2. The coal is then sheared from the top of the seam towards the bottom. Upon reaching the end of its shear cycle (step 3), the cutting head is raised to the top of the mine face as the machine advances (step 4) to a position to begin the sump-shear cycle again. Thereafter or simultaneously with repositioning, the coal is conveyed away (step 5) and the process is started again at step 6 which corresponds to the initial sumping step. As is common in continuous mining operations, once the mined material is sheared off the mine face it may be conveyed away (step 5) from the mine face and mining machine to a shuttle car (not shown) via a loader located beneath the coal mine face. Sumping may also originate at the bottom of the coal face in steps 2 and 6, in which case shearing (step 3) is from the bottom to the top of the coal mine face.

FIG. 5 illustrates how the cutting head of FIGS. 3 to 4 could conceivably be retrofitted on an existing Jeffrey Jeflrex 120 rotary drum continuous mining machine. Basically, this modification would remove the dust producing rotary head and replace it with the nonrotary seven bit head of FIGS. 3 and 4. Appropriate hydraulic cylinders 14 would be powered by electrically powered pumps from a remote electric power source via cable 15 to provide the power to sump and shear the coal face. These cylinders cause the head to move up and down. Shearing could also be accomplished in a horizontal or a side to side direction by orienting the cylinders differently and turning the head 90° so that its bits were aligned in a vertical plane.

Notwithstanding the foregoing illustrative example in FIGS. 3 to 5 of the type of equipment which could be used to practice our method, no limitation of the invention should be construed thereof as the scope and extent of the invention should be measured only by the claims which follow.

We claim:

1. A method of operating a continuous mining machine having a nonrotary type cutting head with a longitudinal axis to reduce the generation of dust particles at the mine face comprising the steps of:

positioning said machine in an operative position near to the mine face surface to be worked;

sumping into said mine face surface beginning on one of the peripheral sides thereof at a mine face depth of at least three inches with said nonrotary cutting head;

after sumping along said longitudinal axis, shearing substantially perpendicular to said longitudinal axis said mine face at a substantially constant depth equal to the same depth as sumped, said shearing being across most of the mine's face entire width and height without retracting said cutting head from its sumped depth;

conveying said dislodged material away from said mining machine and mine face; and repeating the positioning, sumping, and shearing steps in that order.

2. The method of claim 1 wherein said sumping is at a depth of about six inches beginning near the mine roof; and said shearing step takes place beginning at the same position and continues to the mine face floor.

3. The method of claim 1 wherein said sumping step takes place with a cutting head having a plurality of substantially identical bits that are horizontally aligned with each other.

4. The method of claim 1 including the additional step of supplying fluid under a pressure of several thousand pounds per inch pressure to the mine face to aid in the cutting action prior to said sumping step.

5. The method of claim 4 including the additional step of supplying said fluid under pressure during said shearing step to the mine face.

6. The method of claim 1 wherein said shearing takes place horizontally from one side of the mine face to the other with said head turned ninety degrees to position the bits in a vertical line prior to sumping.

7. The method of claim 1 wherein said shearing takes place vertically from the top of the mine face to its bottom.

8. The method of claim 1 wherein said sumping step begins near the mine floor at a depth of about six inches; and said shearing step takes place beginning at the same position and continues to the mine face roof.

9. A method of operating a continuous mining machine having two identical nonrotary type cutting heads each with its own longitudinal axis to reduce the generation of dust particles at the mine face comprising the steps of:

positioning said machine in an operative position near the mine face area to be worked;

first sumping into said mine face near the roof at a depth of at least three inches with one of said heads;

sumping substantially along the heads longitudinal axis into said mine face simultaneously near its floor opposite said first sump at a depth of at least three inches with the other of said two heads;

after said sumping steps, shearing substantially perpendicular to the heads' longitudinal axis said mine face with both of said heads at a substantially constant depth equal to approximately the same depth as sumped, said shearing being towards each other without retracting said cutting heads from the mine face while shearing;

conveying said dislodged material away from said mining machine and mine face; and repeating the positioning, sumping, and shearing steps in that order.

10. The method of claim 9 wherein said sumping steps take place at a depth of about six inches.

11. The method of claim 9 including the additional step of supplying water under a pressure of several thousand pounds per square inch pressure aid in the cutting of to the mine face prior to said sumping step.

* * * * *